US009528191B2

(12) United States Patent
Krouse et al.

(10) Patent No.: US 9,528,191 B2
(45) Date of Patent: Dec. 27, 2016

(54) ELECTROLYTIC APPARATUS, SYSTEM AND METHOD FOR THE EFFICIENT PRODUCTION OF NITROGEN TRIFLUORIDE

(71) Applicant: AIR PRODUCTS AND CHEMICALS, INC., Allentown, PA (US)

(72) Inventors: Steven Arnold Krouse, Tamaqua, PA (US); Reinaldo Mario Machado, Allentown, PA (US); James Joseph Hart, Fogelsville, PA (US); James Patrick Nehlsen, East Stroudsburg, PA (US)

(73) Assignee: AIR PRODUCTS AND CHEMICALS, INC., Allentown, PA (US)

( * ) Notice: Subject to any disclaimer, the term of this patent is extended or adjusted under 35 U.S.C. 154(b) by 67 days.

(21) Appl. No.: 14/560,023

(22) Filed: Dec. 4, 2014

(65) Prior Publication Data

US 2015/0240367 A1 Aug. 27, 2015

Related U.S. Application Data

(60) Provisional application No. 61/944,911, filed on Feb. 26, 2014.

(51) Int. Cl.

| | |
|---|---|
| ***C25B 1/24*** | (2006.01) |
| ***C25B 9/08*** | (2006.01) |
| ***C25B 15/02*** | (2006.01) |
| ***C25B 15/08*** | (2006.01) |
| ***C25B 1/02*** | (2006.01) |

(52) U.S. Cl.
CPC . *C25B 9/08* (2013.01); *C25B 1/02* (2013.01); *C25B 1/245* (2013.01); *C25B 15/02* (2013.01); *C25B 15/08* (2013.01)

(58) Field of Classification Search
CPC ..... C25B 1/245
See application file for complete search history.

(56) References Cited

U.S. PATENT DOCUMENTS 3,235,474 A * 2/1966 Tompkins, Jr. ..... C25B 1/245 204/284
5,085,752 A 2/1992 Iwanaga et al.
(Continued)

FOREIGN PATENT DOCUMENTS

JP 04193973 A 7/1992

*Primary Examiner* — Harry D Wilkins, III
(74) *Attorney, Agent, or Firm* — Anne B. Kiernan; Joseph D. Rossi

(57) ABSTRACT

An electrolytic cell which is partitioned into one or more anode chambers and cathode chambers by one or more partition walls between each anode chamber and cathode chamber, wherein each anode chamber comprises one or more anodes comprising an inner surface and an outer surface, and each cathode chamber comprises one or more cathodes, wherein the anode chamber and the cathode chamber are configured such that any one of the one or more cathodes is adjacent to the outer surface of the one or more anodes and there is no cathode adjacent to the inner surface of the one or more anodes; a molten salt electrolyte surrounding the one or more anodes and the one or more cathodes; at least one anode gas outlet for withdrawing gas from the anode chamber; and at least one cathode gas outlet for withdrawing gas from the cathode chamber.

20 Claims, 2 Drawing Sheets

(56) References Cited

U.S. PATENT DOCUMENTS

| | | | | |
|---|---|---|---|---|
| 6,984,366 | B2 | 1/2006 | Syvret et al. | |
| 2004/0149570 | A1* | 8/2004 | Hiraiwa | C25B 1/245 204/243.1 |
| 2008/0314759 | A1* | 12/2008 | Furuta | C25B 1/245 205/556 |
| 2009/0159437 | A1* | 6/2009 | Maumus | C25B 9/04 204/286.1 |
| 2009/0205952 | A1* | 8/2009 | Maumus | C25B 1/245 204/252 |
| 2010/0116649 | A1* | 5/2010 | Maekawa | C25B 11/03 204/247 |
| 2012/0181182 | A1* | 7/2012 | Hart | C25B 1/245 205/335 |
| 2014/0110269 | A1* | 4/2014 | Nehlsen | C25B 11/02 205/359 |

* cited by examiner

ELECTROLYTIC APPARATUS, SYSTEM AND METHOD FOR THE EFFICIENT PRODUCTION OF NITROGEN TRIFLUORIDE

CROSS-REFERENCE TO RELATED APPLICATIONS

This patent application is a non-provisional of U.S. provisional patent application Ser. No. 61/944,911, filed on Feb. 26, 2014, which is incorporated herein by reference in its entirety.

BACKGROUND OF THE INVENTION

This invention relates to an electrolytic apparatus used for producing nitrogen trifluoride gas by a molten salt electrolysis. In particular, this invention relates to a structural configuration of an electrolytic cell, which leads to a more efficient production of nitrogen trifluoride gas. The invention further relates to electrolytic cells and to methods and systems which are useful for efficiently producing nitrogen trifluoride gas.

There is currently a large and growing requirement of nitrogen trifluoride ($NF_3$) gas for use in semiconductor manufacturing. Nitrogen trifluoride may be used, for example, as an etchant or chamber cleaning gas. Demand for these uses has significantly increased in recent times. In such applications, a nitrogen trifluoride gas of high purity and having a carbon tetrafluoride ($CF_4$) by-product content as low as possible is desired.

$NF_3$ gas can be manufactured by various methods. Among them, a molten salt electrolysis gives good yield and is suitable for mass production as compared with other methods and therefore, is regarded as a useful commercial process. In particular, for the purpose of producing a highly pure $NF_3$ gas containing only a small amount of $CF_4$, the molten salt electrolysis method can produce $NF_3$, at the lowest cost. In general, according to a process for producing $NF_3$ gas by a molten salt electrolysis, exemplary suitable molten salt baths comprise acidic ammonium fluoride, $NH_4F.HF$ systems derived from ammonium fluoride and hydrogen fluoride, or $KF.NH_4F.HF$ systems produced by adding acidic potassium fluoride or potassium fluoride to the $NH_4F.HF$ system.

In the process of manufacturing $NF_3$ gas, $NF_3$ gas and nitrogen ($N_2$) gas are generated at the anode while hydrogen ($H_2$) gas is generated at the cathode. That is, gas generating reactions occur at the both electrodes. When $NF_3$ gas generated at anode is mixed with $H_2$ gas generated at cathode, there is a risk of explosion and, therefore, it is necessary to minimize the likelihood of $H_2$ mixing with $NF_3$ at the anode in amounts that may cause explosion. Moreover, the presence of $H_2$ in the anode will lead to other unwanted reactions, such as, for example, with $F_2$ and $NF_3$ to form HF and $N_2$, which decreases the efficiency of the cell and the productivity of $NF_3$.

The geometry of prior art electrolytic cells for generating $NF_3$ can contribute to the problem of $H_2$ migration to the anode by limiting the circulation of formed gases and liquid electrolyte around the cathode and the anode. The longer it takes for the formed gas to be removed from the cell, the more likely that $H_2$ migration to the anode will occur.

Accordingly, there remains a need for a safe and efficient manufacturing apparatus and method for the continuous production and generation of $NF_3$ while producing substantially no unwanted by-products.

SUMMARY OF THE INVENTION

The present invention satisfies this need by providing an electrolytic apparatus for producing nitrogen trifluoride by electrolyzing a hydrogen fluoride-containing molten salt electrolyte at an applied current density, which comprises: an electrolytic cell which is partitioned into one or more anode chambers and cathode chambers by one or more partition walls between each anode chamber and cathode chamber, wherein each anode chamber comprises one or more anodes comprising an inner surface and an outer surface, and each cathode chamber comprises one or more cathodes, wherein the anode chamber and the cathode chamber are configured such that any one of the one or more cathodes is adjacent to the outer surface of the one or more anodes and there is no cathode adjacent to the inner surface of the one or more anodes; a molten salt electrolyte surrounding the one or more anodes and the one or more cathodes; at least one anode gas outlet for withdrawing gas from the anode chamber; and at least one cathode gas outlet for withdrawing gas from the cathode chamber.

DETAILED DESCRIPTION

Figure 1:
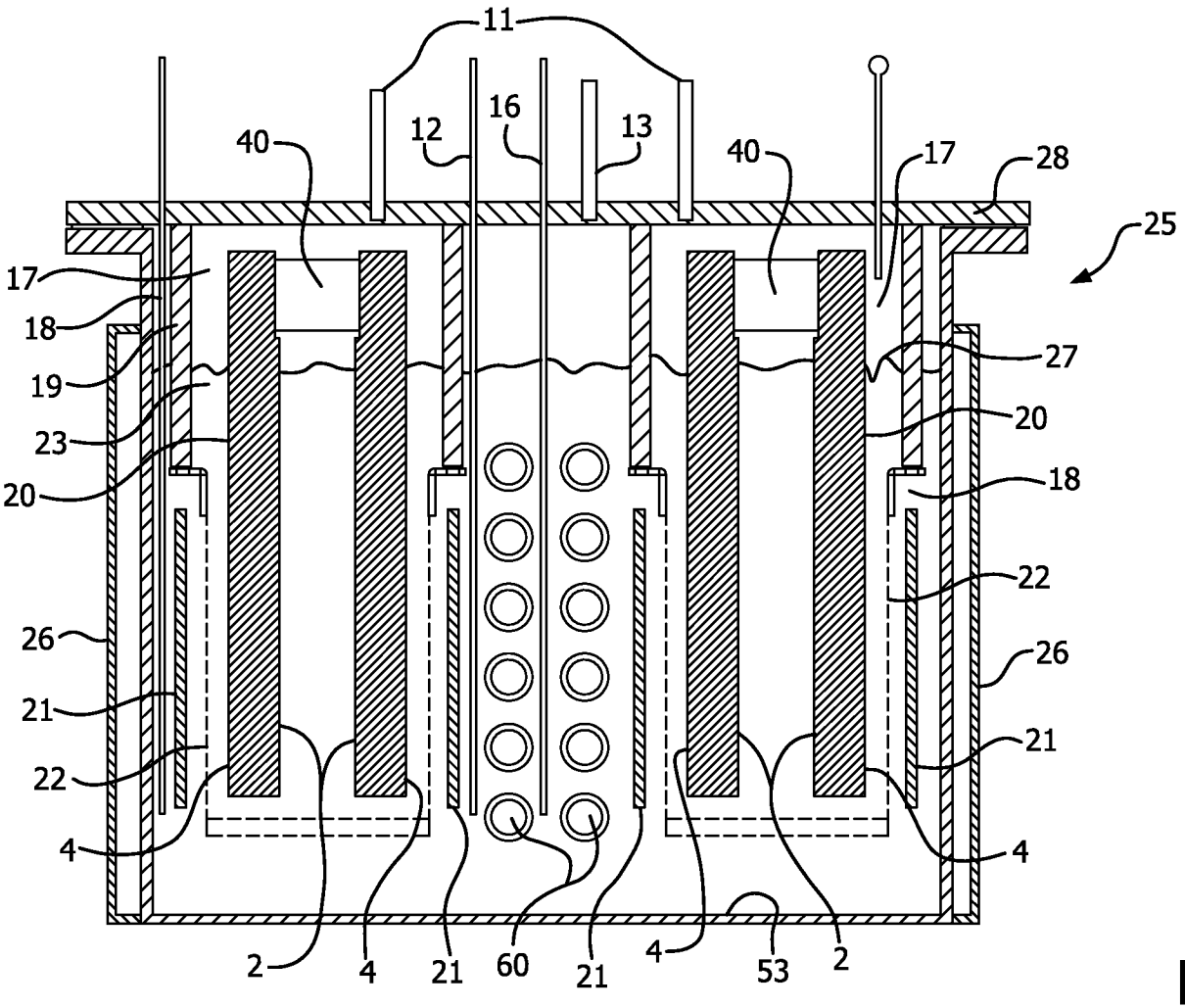
FIG. 1 is a cross-sectional view of one embodiment of an electrolytic cell according to the invention.

This invention relates to a fluorine containing gas generation system comprising an electrolytic cell which utilizes a hydrogen fluoride (HF) containing molten salt electrolyte. Although the specific invention relates to an electrolytic cell producing $NF_3$ as the primary product, it is recognized that this invention can also be applied with benefit to an electrolytic cell for which $F_2$ is the primary product. It was also surprisingly found that the apparatus and system of the present invention yields an increased current efficiency of up to about 100% and a corresponding increase in production of $NF_3$ relative to prior art electrolytic cells used in the production of $NF_3$.

For producing $NF_3$ by using the electrolytic apparatus of the present invention, the HF-containing electrolyte, can be any known HF-containing electrolyte that is useful in making $NF_3$, such as, for example, molten $NH_4F$ and HF (referred to as the "binary electrolyte") or an HF-containing molten salt of ($NH_4F$), or KF and HF (referred to as the "ternary electrolyte"). In addition, the HF-containing molten salt electrolyte may also contain other additives such as cesium fluoride and/or lithium fluoride for improving performance. The concentrations may be expressed in terms of mol % $NH_4F$ and HF ratio. The HF ratio is defined by the equation below:

$$\text{HF Ratio} = \text{moles of HF titratable to neutral pH} / (NH_4F(\text{moles}) + KF(\text{moles}))$$

The HF ratio represents the ratio of the free HF level to the total salt in the electrolyte. In some embodiments with the ternary electrolyte, it may be preferable to operate the electrolytic cell with the $NH_4F$ concentration in the range of 14 wt % and 24 wt %, more preferably between 16 wt % and 21 wt %, most preferably between 17.5 wt % and 19.5 wt %; with the HF ratio preferably between 1.3 and 1.7, more preferably between 1.45 and 1.6, most preferably between 1.5 and 1.55. In other embodiments, the preferred concentration range may vary depending on the operating conditions such as applied current and electrolyte temperature. The preferred concentration range may also be different in embodiments containing the binary electrolyte. It is desirable to choose the concentration range based on a balance between high efficiency of the electrolytic cell and safe operation. Such a balance may be achieved by operating the cell with 0.5% to 5% mol $F_2$ in the anode chamber (product) gas. Operating the cell at conditions that result in the production of high fluorine concentration in the anode product gas decreases the efficiency of the cell; however, lower percentages or no fluorine in the anode product gas may represent less safe conditions.

With respect to the method for producing a hydrogen fluoride-containing binary electrolyte, there is no particular limitation, and any conventional method can be used. For example, a HF-containing binary electrolyte can be produced by feeding anhydrous hydrogen fluoride into ammonium hydrogen difluoride and/or $NH_4F$. With respect to the method for producing a HF-containing ternary electrolyte, there is no particular limitation, and any conventional method can be used. For example, a HF-containing ternary electrolyte can be produced by feeding anhydrous HF and ammonia into a mixture of KF with ammonium hydrogen difluoride and/or $NH_4F$.

This invention is not limited to any specific electrolyte composition, and any description herein referring to, for example, the binary electrolyte comprising HF and ammonia is for convenience only. It is understood that any electrolyte useful for making $NF_3$ can be substituted into the description and is included in the invention.

The electrolysis of HF-containing molten salt electrolyte comprising $NH_4F$ results in the evolution of hydrogen at the cathode and a gaseous mixture at the anode containing nitrogen trifluoride, nitrogen, and small amounts of various other impurities. In a conventional electrolytic cell, one or a plurality of anodes and one or a plurality of cathodes are employed. In some electrolytic cells for the production of $NF_3$, the cathodes are separated from the anodes by suitable means such as one or more diaphragms to prevent mixing of the hydrogen with gaseous mixture containing $NF_3$. However, even with such cells an amount of hydrogen sufficient to produce an explosive mixture can leak into the anode compartment and become mixed with the gaseous mixture containing $NF_3$ thereby forming part of the gaseous mixture. The inventors have also determined that hydrogen may also be produced in the anode chamber either by electrochemical means due to polarization of the diaphragm or by chemical means involving by-product chemistry.

The following mechanisms can account for hydrogen present in the anode product gas, which can result in a formation of a meta-stable flammable mixture. In one mechanism, hydrogen bubbles formed at the cathode can migrate from the cathode chamber into the anode chamber releasing hydrogen gas into the anode gas. This can occur when the convective electrolyte flow carries hydrogen bubbles through the diaphragm during typical operating conditions. When the cell is operated so that an excess of fluorine exists in the anode gas then any hydrogen migrating into the anode chamber will react rapidly with the fluorine to form HF.

In another mechanism, which the inventors have discovered, hydrogen can be made chemically in the anode chamber under chemical reaction conditions where the local fluorine concentration is very low and the reaction rate of fluorine with $NH_4F$ is relatively fast. In this scenario fluorine reacts rapidly with $NH_4F$ to form mono-fluoro-ammonium fluoride. Then before the mono-fluoro-ammonium fluoride can react with fluorine, it reacts with ammonium to form nitrogen and hydrogen according to Equations 1 and 2.

$$F_2+NH_4^+.F^-\rightarrow NFH_3^+.F^-+HF \quad \text{Equation 1}$$

$$NH_4^+.F^-+NFH_3^+.F^-\rightarrow N_2+2H_2+3HF \quad \text{Equation 2}$$

Physical barriers (for example, the diaphragm and the skirt) may help to prevent the hydrogen from traveling from the cathode to the anode side of the cell, but will not avoid the hydrogen created on the anode side from entering the anode side product gas stream.

According to the present invention, there is provided an electrolytic apparatus for producing nitrogen trifluoride by electrolyzing a hydrogen fluoride-containing molten salt electrolyte at an applied current density that is generally in the range of from 0.1 to 30 A/dm$^2$, or from 0.3 to 15 A/dm$^2$, or from 0.6 to 12 A/dm$^2$, which comprises: an electrolytic cell which is partitioned into one or more anode chambers and cathode chambers by one or more partition walls between each anode chamber and cathode chamber, wherein each anode chamber comprises one or more anodes comprising an inner surface and an outer surface, and each cathode chamber comprises one or more cathodes, wherein the anode chamber and the cathode chamber are configured such that any one of the one or more cathodes is adjacent to the outer surface of the one or more anodes and there is no cathode adjacent to the inner surface of the one or more anodes; a molten salt electrolyte surrounding the one or more anodes and the one or more cathodes; at least one anode gas outlet for withdrawing gas from the anode chamber; and at least one cathode gas outlet for withdrawing gas from the cathode chamber.

Design and Construction of the Cell

FIG. 1 shows a schematic representation of the principal parts of the electrolytic cell apparatus of the present invention for the production of nitrogen trifluoride comprising product gas. The electrolytic cell apparatus comprises an electrolytic cell 25 having an electrolyzer body 26 and an upper lid or covering 28. The cell 25 is partitioned into anode chambers 17 and cathode chambers 18 by vertically disposed gas separation skirt 19 and diaphragm 22. The gas separation skirt 19 is preferably solid and the diaphragm 22 is preferably perforated or woven such that it is porous. The function of the gas separation skirt 19 and the diaphragm 22 positioned vertically between the anode and cathode chambers is to prevent the $NF_3$ containing anode product gas from being mixed with hydrogen containing cathode product gas during electrolysis.

One or more anodes 20 are disposed in the anode chambers 17. Anodes 20 are preferably U-shaped configuration with the anodes attached to a copper buss bar 40 as is depicted in FIG. 1 and have an inner surface 2 and an outer surface 4. Preferably, anodes 20 are made of non-graphitized carbon. One or more cathodes 21 are disposed in the cathode chambers 18. Cathodes 21 are preferably made of carbon steel.

In preferred embodiments, the anodes are spaced apart from each other by gaps between adjacent anodes where the gap distance is less than anode width to allow flow around and behind the anodes.

In the embodiment shown in FIG. 1, the electrolytic cell 25 contains a hydrofluoric acid and ammonia containing molten salt electrolyte 23. The level 27 of electrolyte 23 is the height of the electrolyte above the bottom surface 53 of the electrolytic cell 25. Importantly, the level 27 of electrolyte 23 is above cathodes 21 such that cathodes 21 are completely submerged in electrolyte 23 and such that anodes 20 extend above the level 27 of electrolyte 23.

The electrolytic cell 25 has feed tubes 12 and 16 for feeding raw materials or the components that make up the electrolyte 23. As shown in FIG. 1, feed tube 12 is a HF feed tube 12 and feed tube 16 is an ammonia feed tube 16. In other embodiments, one or both of the feed tubes 12 and 16 may also be used to directly feed thereto a pre-mixed HF and ammonia containing molten salt electrolysis liquid. In general, the feed tubes 12 and 16 are provided in the cathode chamber 18. The anode chamber 17 has an anode product outlet pipe 11 for withdrawing the $NF_3$ containing product gas mixture from the electrolytic cell 25. The cathode chamber 18 has a cathode product outlet pipe 13 for withdrawing gas from the electrolytic cell 25. If desired, the electrolytic apparatus of the present invention may further comprise additional components such as purge gas pipe connections in the anode and cathode chambers. A purge gas source (not shown), such as nitrogen for example, may be connected to the anode chamber 17 and/or the cathode chamber 18 (not shown) of the electrolytic cell to provide for a purge of the electrolytic cell for safety reasons or to provide a blow-out means for clogged pipes or to otherwise provide for the proper functioning of the inlet and outlet tubes and pipes and other instrumentation.

When the cell of this embodiment is operated, the nitrogen trifluoride containing gas is generated at the anode and the hydrogen is generated at the cathode. The gases generated at the anode chamber may comprise nitrogen trifluoride ($NF_3$), Nitrogen ($N_2$) and fluorine ($F_2$). In addition, HF has a vapor pressure over the electrolyte 23 and is therefore present in the gas leaving both the anode chamber 17 and cathode chamber 18.

The cell 25 shown in FIG. 1 may also comprise a current controller that supplies current to the anode 20 through an anode current connection and to the cathode 21 through a cathode current connection at a level that can be increased or decreased within a target range specified by the operator or the control process for the electrolytic cell.

The apparatus shown in FIG. 1 may also comprise a means to measure the level or level indicator of the electrolyte which communicates with an electrolyte feed flow controller. The feed flow controller also communicates with and controls a flow control valve which is in communication with a HF source and communicates with and controls a flow control valve in communication with an ammonia source. As electrolysis proceeds and the molten salt electrolyte become depleted, the level indicator signals the feed flow controller that the electrolyte needs to be replenished. The electrolyte feed flow controller communicates to the flow control valves and has ammonia and HF fed into the molten electrolyte from an ammonia source using a flow control valve and a HF source using a flow control valve respectively. The flow control valve can be used to adjust the feed rate of ammonia from ammonia source based on the consumption rate of the ammonia to form nitrogen trifluoride containing gas. The composition rate of the ammonia and the other components in the electrolyte may be obtained from mass balance involving product gas composition and product gas flow.

The level of the electrolyte is the height of the electrolyte above the bottom surface 53 of the cell 25. There may be one or more level indicators or detectors in a cell, for example, one each in the anode chamber and the cathode chamber to account for the differential pressure that may exist between the two chambers that causes two separate electrolyte levels. The level detectors may be based on any of the different methods available such as current conduction or gas bubbler system. The electrolyte level is set to an appropriate value taking into account the geometry of the electrolytic cell and the operating conditions of the electrolytic cell. The electrolyte level is adjusted by a feed flow controller which controls the flow of the electrolyte feed into the cell. The electrolyte feed flow controller controls the valve that controls the flow of HF from a HF source to the electrolytic cell apparatus and controls the valve that controls the flow of ammonia from the ammonia source to the cell. The electrolyte feed flow controller takes into consideration the level of the electrolyte in the cell prior to adding electrolyte feed to the cell. The level indicator communicates the level to the electrolyte feed flow controller. The electrolyte feed flow controller will have feed added to the cell if the level falls below the target level.

A temperature detector may also be provided in the cell for measuring the temperature of the electrolyte 23. The temperature detector may be a thermocouple, or other direct or indirect, contact or non-contact, temperature measuring means known in the art. The cell 25 is typically provided with a temperature adjusting means which may be a heat transfer fluid jacket disposed around and/or in contact with at least part of the outer surface of the cell. If employed, the heat transfer fluid jacket circulates heated or room temperature or cooled heat transfer fluid depending on if the temperature of the electrolyte is to be increased or decreased; that is if the cell, particularly the electrolyte therein, is to be heated or cooled. The heat transfer fluid may be any fluid that is considered suitable to be used for the purposes described herein, for example, water, glycol and mineral oil. In some embodiments, such as that shown in FIG. 1, alternatively or additionally, the temperature adjusting means may comprise heat transfer tubes 60 having a circulating heating or cooling medium that may be present inside the electrolytic cell 25 below the electrolyte level and/or are embedded in the bottom or side walls of the cell body. In preferred embodiments, the heat transfer tubes lie outside of the electrolysis zone behind the cathode.

Alternatively, other heating means or cooling means may be used, for example resistive heaters, air blowers and others known to the art. The flow of the heat transfer fluid is controlled by the electrolyte temperature controller which may comprise a pump, a heater and a cooling means, which are not shown in the figure. The electrolyte temperature controller receives input from the temperature detector and may automatically adjust or maintain the operation of the temperature adjusting means in response to the temperature of the electrolyte in response to that temperature reading. Adjusting the temperature of the electrolyte via the temperature adjusting means may alternatively be done manually. The temperature adjusting means in the embodiment shown may open or close a valve to cause more heating or cooling fluid to flow or may cause a heater to increase the temperature of the heat transfer medium or may cause the heater to stop heating the heat transfer medium to decrease its temperature and thereby the temperature of the electrolyte.

In the electrolysis performed in the present invention, with respect to the temperature of the electrolyte 23, the low end of the operating temperature range for the electrolyte is the minimum temperature needed to maintain the electrolyte in a molten state. The minimum temperature needed to maintain the electrolyte in a molten state depends on the composition of the electrolyte. In some embodiments, the temperature of the electrolyte 23 is typically from 85 to 140° C. or from 100 to 130° C.

Any material may be used to construct the components of the cell so long as the materials are durable when exposed to the corrosive conditions of the cell. Useful materials for the cell body, separation skirt and diaphragm are iron, stainless steel, carbon steel, nickel or a nickel alloy such as Monel®, and the like, as known to a person of skill in the art.

In preferred embodiments, the components are arranged as follows:

| Components | Distance (mm) |
|---|---|
| Cathode to Diaphragm | 15 to 20 |
| Anode to Diaphragm | 15 to 20 |
| Cathode to Cell Bottom | 100 to 130 |
| Anode to Cell Bottom | 120 to 140 |
| Electroltye Level to Cell Top | 140 to 160 |

Cell Performance

In view of the design features described above, maximization of electrolyte circulation is achieved by maximizing the use of free convection and bubble convection as follows.

Anode

In the anode chamber, the anode gas consisting of $NF_3$, HF and $F_2$ rises in lenticular bubbles on the carbon anode. Without intending to be bound by any particular theory, the lenticular bubbles adhere to the surface of the carbon anode to create transient gas channels which allow the gas to rise into the free gas space in the anode chamber above the liquid electrolyte. Thus, electrolyte circulation near the surface of the anode is driven by the rising anode gas. The gas bubbles in front of the anode (facing cathode) drive liquid flow upward and free convection in front of the anode caused by joule heating drives liquid flow upward.

Cathode

In the cathode chamber, the cathode gas consisting of $H_2$ and HF bubbles rise freely in the electrolyte. Without intending to be bound by particular theory, the cathode gas bubbles range from approximately 0.1 mm to 1 mm and break away from the carbon steel cathode. These bubbles rise freely in the electrolyte generating liquid electrolyte flow within the cathode chamber. If the gap is too wide between the cathode and the porous diaphragm then the driving force for circulation is reduced. The narrower gap allows for higher local gas hold up and greater superficial velocity to drive liquid circulation. The gas bubbles in front of the cathode (facing anode) drive liquid flow upward, and free convection in front of the cathode caused by joule heating drives liquid flow upward. The cooling surface behind the cathode drives liquid flow downward.

The present inventors have surprisingly discovered that improved/increased circulation within the cell has many benefits. For example, improved/increased circulation reduces the cross-over of hydrogen from the cathode chamber into the anode chamber. Moreover, improved/increased circulation controls temperature near the anode surface by renewal of cooled electrolyte into the anode chamber thus favoring $NF_3$ formation over $N_2$ formation because such selectivity is a function of temperature.

The method of this invention of employing the electrolytic apparatus detailed above is used to maintain the amount of hydrogen in the anode product gas stream below the explosive amount, that is, less than 5 mol % by the method of this invention. To ensure that the amount of hydrogen is present in amounts that are less than the explosive amount, the amount of hydrogen may be maintained so that it is present at less than 4 mol %, less than 3 mol %, less than 2 mol %, less than 1 mol % or in non-detectable quantities.

The following Examples further illustrate the benefits of the present invention.

EXAMPLES

Figure 2:
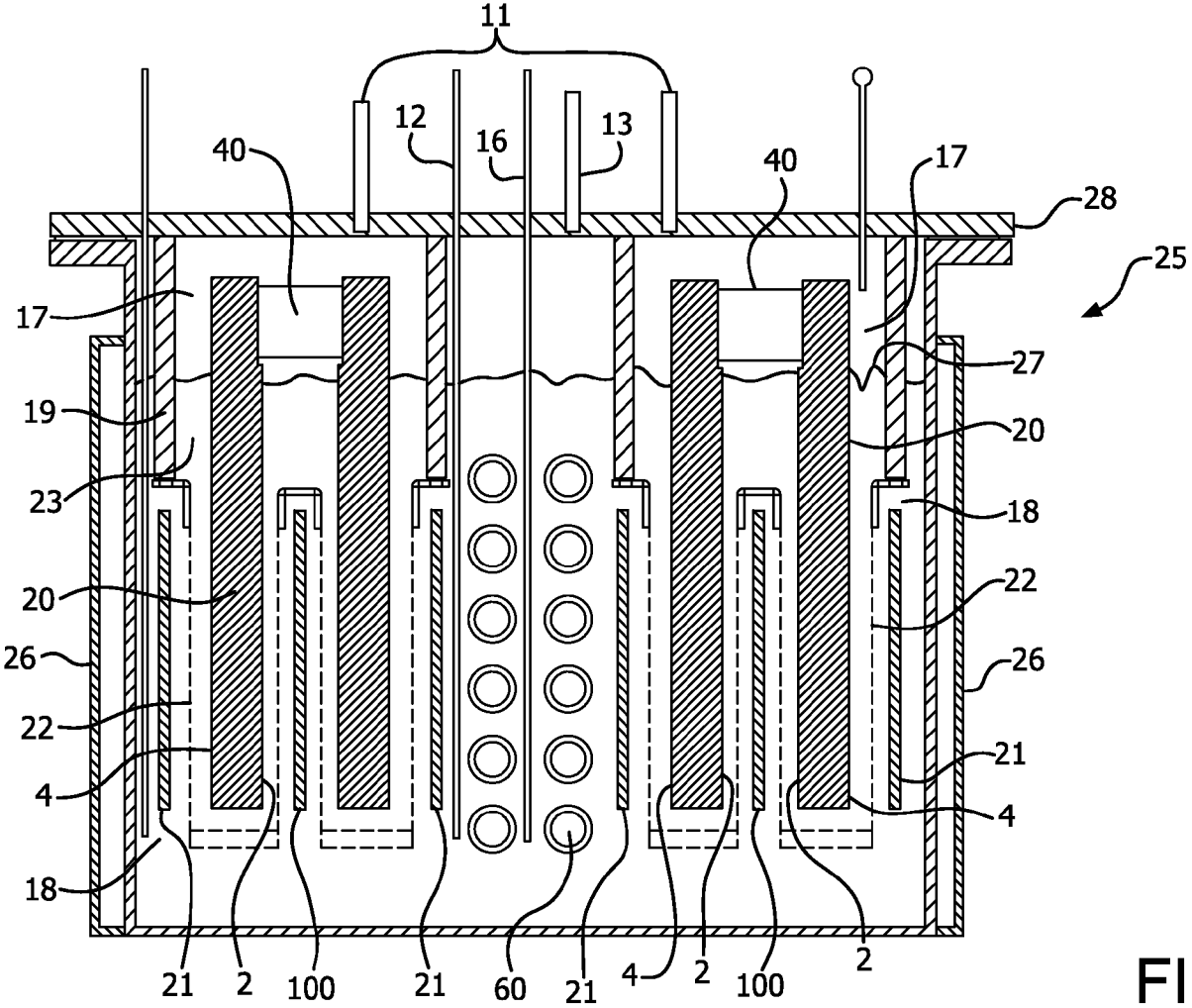
FIG. 2 is a cross-sectional view of a prior art AEC cell.

The electrochemical cell used in the examples which follow are as described by A. P. Huber, J. Dykstra and B. H. Thompson, "Multi-ton Production of Fluorine for Manufacture of Uranium Hexafluoride", *Proceedings of the Second United Nations International Conference on the Peaceful Uses of Atomic Energy*, Geneva Switzerland, Sep. 1-13, 1958. The anode blades used were YBDXX grade from Graftech International (USA), with dimensions 2 inches×8 inches×22 inches. However, any carbon anode material known in the art to be useful for production of $F_2$ or $NF_3$ could be used to similar affect. Such anodes include those produced by manufacturers such as SGL Group (Germany) and Toyo Tanso (Japan). The body of the cell was made of Monel® with a height of 30 inches, a width of 32 inches and a length of 74 inches. For Design 1 the projected active anode area was 12 inches×8 inches×32 blades×2 sides/blade=6144 $in^2$ or 3.96 $m^2$. For Design 2 the projected active anode area was 12 inches×8 inches×32 blades×1 side/blade=3072 $in^2$ or 1.98 $m^2$. The initial ternary electrolyte consisted of 18 wt % $NH_4F$, and 44 wt % KF with a HF ratio of 1.5. For the Experiments detailed below, Design 2 is the electrolytic apparatus employing the cell design of the present invention and depicted in FIG. 1. Design 1 is the control apparatus of FIG. 2, which is a conventional AEC cell having a cathode adjacent to the inner surfaces of the anodes. In FIG. 2, the cathodes adjacent to the inner surfaces of the anodes are labeled as reference numeral 100. The following Table highlights certain of the differences between the two designs.

| | | Design 1 | Design 2 |
|---|---|---|---|
| Cathode | Submerged below liquid | YES | YES |
| | Cooling behind all cathode | NO | YES |
| | Liquid flow behind all cathode | NO | YES |
| Anode | Anode above liquid level | YES | YES |
| | Flow behind anodes | NO | YES |
| | Flow restrictions behind anode reduced | | |

Experiment 1

$NF_3$ Productivity and Purity

Cells according to Design 1 and 2 were supplied with 32 YBDXX grade anodes from GrafTech International and were operated between 3000 and 5000 A. These currents corresponded to anode current densities between 7.6 and 12.6 A/$dm^2$ for the Design 1 cell and between 15.1 and 25.2 A/$dm^2$ for the Design 2 cell. The Design 1 cells were operated for an average of $17\times10^6$ Ah or 177 days (where Ah=Amp hours=average amps×hours on-line) and the Design 2 cells were operated for an average of $13\times10^6$ Ah or 135 days The cells were maintained at a cell temperature between 127 and 130° C. The electrolyte composition was maintained in the range, HF=37±1%, LiF=1±0.25%, KF=44±1%, $NH_4F$=18±1%, by the addition of ammonia and HF to the cell and the $F_2$ level in the anode gas maintained between 0.5% and 4%.

The results are illustrated in the following Table:

| | Design 1 | Design 2 |
|---|---|---|
| $NF_3$ Productivity Kg/hr-kA | 0.33 | 0.44 |
| (std dev) | (0.05) | (0.03 |
| ppm $CF_4$ on pure $NF_4$ basis | 71 | 22 |
| (std dev) | (62) | (28) |
| Cell resistance Milli-ohms | 0.437 | 0.728 |
| (std dev) | (0.097) | (0.031) |

Cell Resistance Calculation $$\text{Cell(milli-ohm)} = \frac{(V-5.6)}{I}$$

$$I = \text{current}(kA)$$

$$V = \text{cell potential}(V)$$

NF3 Productivity Calculation for Operation at Steady-State $$NF_3(\text{kg/hr}-kA) = \frac{\left[\frac{y_{NF_3}}{y_{NF_3}+2y_{N_2}}\right]\cdot\left[\frac{Mwt_{NF_3}}{Mwt_{NH_3}}\right]\cdot\left(\frac{dm_{NH_3}}{dt}\right)}{I}$$

$$I = \text{current}(kA)$$

$$\frac{dm_{NH_3}}{dt} = \text{mass flow of ammonia (kg/hr)}$$

$y_{NF_3}$, $y_{N_2}$ = gas phase mole fractions of $NF_3$ and $N_2$ respectively $Mwt_{NF_3}$, $Mwt_{NH_3}$ = molecular weight of $NF_3$ and $NH_3$ respectively

Example 2

$NF_3$ Current Efficiency

Cells according to Design 1 and 2 were supplied with 32 YBDXX grade anodes from GrafTech International and were operated at an average current of 4000 A. The cells were maintained at a cell temperature between 127 and 130° C.

The results are illustrated in the following Table:

| | Design 1 | Design 2 |
|---|---|---|
| Average Cell Current, A | 4000 | 4000 |
| Average anode current density, A/dm$^2$ | 10 | 20 |
| Average Cell potential, V | 7.35 | 8.51 |
| $NF_3$ current efficiency | 71% | 99% |
| $NF_3$ Productivity, kg/hr | 1.30 | 1.80 |
| ppm $CF_4$ on pure $NF_3$ basis | 71 | 22 |
| (standard deviation) | (62) | (28) |

Examples 1 and 2 illustrate that the $NF_3$ productivity in a given cell size can be increased even as the cell resistance, anode current density and cell potential are increased provided the cell geometry is adjusted to maximize liquid/electrolyte circulation.

The foregoing description is intended primarily for purposes of illustration. Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

We claim:

1. An electrolytic apparatus for producing nitrogen trifluoride by electrolyzing a hydrogen fluoride-containing molten salt electrolyte at an applied current density, which comprises:

an electrolytic cell which is partitioned into one or more anode chambers and cathode chambers by one or more partition walls between each anode chamber and cathode chamber, wherein each anode chamber comprises one or more anodes comprising at least one inner surface and at least two outer surfaces arranged opposite to each other with the at least one inner surface arranged between the at least two outer surfaces, and each cathode chamber comprises one or more cathodes, wherein the anode chamber and the cathode chamber are configured such that any one of the one or more cathodes is adjacent to at least one of the outer surfaces of the one or more anodes and there is no cathode adjacent to the at least one inner surface of the one or more anodes;

a molten salt electrolyte surrounding the one or more anodes and the one or more cathodes, at least one anode gas outlet for withdrawing gas from the anode chamber; and at least one cathode gas outlet for withdrawing gas from the cathode chamber.

2. The apparatus of claim 1 wherein the one or more cathodes are completely submerged in the hydrogen fluoride-containing molten salt electrolyte.

3. The apparatus of claim 1 further comprising at least one inlet.

4. The apparatus of claim 3 wherein the at least one inlet is suitable for receiving a hydrogen fluoride-containing molten salt as an electrolysis liquid.

5. The apparatus of claim 1 wherein the hydrogen fluoride-containing molten salt electrolyte comprises $NH_4F$.

6. The apparatus of claim 5, wherein the hydrogen fluoride-containing molten salt electrolyte is selected from the group consisting of $NH_4F.HF$ and $KFNH_4F.HF$.

7. The apparatus of claim 5 wherein the $NH_4F$ is present in a concentration of from 14 wt % to 24 wt %.

8. The apparatus of claim 1 wherein the one or more anodes are U-shaped.

9. The apparatus of claim 8 wherein the one or more anodes are attached to a copper bus bar.

10. The apparatus of claim 8 wherein the one or more anodes comprise non-graphitized carbon.

11. The apparatus of claim 8 wherein the one or more anodes have a length and width and are spaced apart from each other by gaps between adjacent anodes where the gap distance is less than the anode width to allow flow around and behind the anodes.

12. The apparatus of claim 1 wherein the one or more cathodes comprise carbon steel.

13. The apparatus of claim 1 wherein the electrolyte is at a level above a bottom surface of the cell and the level of the electrolyte is above the one or more cathodes such that the one or more cathodes are completely submerged in the electrolyte: and such that the one or more anodes extend above the level of the electrolyte.

14. The apparatus of claim 1 wherein the at least one anode gas comprises at least one gas selected from the group consisting of nitrogen trifluoride ($NF_3$), nitrogen ($N_2$), and fluorine ($F_2$).

15. The apparatus of claim 1 wherein the at least one cathode gas comprises hydrogen.

16. The apparatus of claim 1 further comprising a current controller that supplies current to the one or more anodes through an anode current connection and to the one or more cathodes through a cathode current connection.

17. The apparatus of claim 1 further comprising a means to measure the level or level indicator of the electrolyte which communicates with an electrolyte feed flow controller.

18. The apparatus of claim 17 wherein the flow controller also communicates with and controls a flow control valve which is in communication with a HF source and communicates with and controls a flow control valve in communication with an ammonia source such that as electrolysis proceeds and the molten salt electrolyte becomes depleted, the level indicator signals the feed flow controller that the electrolyte needs to be replenished and the electrolyte feed flow controller communicates to the flow control valves and has ammonia and HF fed into the molten electrolyte from an ammonia source using a flow control valve and a HF source using a flow control valve respectively.

19. The apparatus of claim 1 wherein the applied current density is in the range of from 0.1 to 30 $A/dm^2$.

20. An electrolytic apparatus for producing nitrogen trifluoride by electrolyzing a hydrogen fluoride-containing molten salt electrolyte at an applied current density, which comprises:

an electrolytic cell comprising a body, a cell bottom, and a cell top, wherein the electrolytic cell is partitioned by a perforated diaphragm into one or more anode chambers and cathode chambers, with the perforated diaphragm positioned between each anode chamber and cathode chamber, wherein each anode chamber comprises one or more anodes comprising at least one inner surface and at least two outer surfaces arranged opposite to each other with the at least one inner surface arranged between the at least two outer surfaces, and each cathode chamber comprises one or more cathodes, wherein the anode chamber and the cathode chamber are configured such that any one of the one or more cathodes is adjacent to the at least one of the outer surfaces of the one or more anodes and there is no cathode adjacent to the at least one inner surface of the one or more anodes;

a molten salt electrolyte surrounding the one or more anodes and the one or more cathodes, wherein the electrolyte is at a level defined by its distance from the cell top:

at least one anode gas outlet for withdrawing gas from the anode chamber; and at least one cathode gas outlet for withdrawing gas from the cathode chamber, wherein the one or more cathodes are at a distance from the porous diaphragm of from 15 to 20 mm, the one or more anodes are at a distance from the porous diaphragm of from 15 to 20 mm, the one or more cathodes are at a distance from the cell bottom of from 100 to 130 mm, the one or more anodes are at a distance from the cell bottom of from 120 to 140 mm, and the level of the electrolyte is at a distance from the cell top of from 140 to 160 mm.

* * * * *